US005163237A

United States Patent [19]

Rosen

[11] Patent Number: 5,163,237

[45] Date of Patent: Nov. 17, 1992

[54] FOOT SUPPORT SYSTEM FOR SHOES

[76] Inventor: Henri E. Rosen, 229 Coolidge Ave., Watertown, Mass. 02172

[21] Appl. No.: 869,901

[22] Filed: Apr. 15, 1992

Related U.S. Application Data

[63] Continuation of Ser. No. 598,182, Oct. 15, 1990.

[51] Int. Cl.[5] ..... A43B 3/26; A43B 7/16; A43B 7/38

[52] U.S. Cl. ..... 36/97; 36/93; 36/30 A; 36/8.4; 36/81; 36/88; 36/140

[58] Field of Search ..... 36/88, 93, 97, 103, 36/43, 30 A, 31, 8.4, 81, 112, 102, 10, 94, 96, 132, 136, 140

[56] References Cited

U.S. PATENT DOCUMENTS

| | | | |
|---|---|---|---|
| 1,249,000 | 12/1917 | Benjamin | 36/43 |
| 1,637,565 | 8/1927 | Gordon | 36/132 |
| 2,194,637 | 3/1940 | Burger | 36/81 |
| 3,442,031 | 5/1969 | Antell | 36/43 |
| 4,252,315 | 2/1981 | Kimura | 36/132 |
| 4,813,157 | 3/1989 | Boisvert et al. | 36/44 |
| 4,813,162 | 3/1989 | Harris | 36/43 |
| 4,823,483 | 4/1989 | Chapnick | 36/44 |
| 4,858,341 | 8/1989 | Rosen | 36/97 |
| 4,901,390 | 2/1990 | Daley | 36/44 |
| 4,967,492 | 11/1990 | Rosen | 36/97 |

FOREIGN PATENT DOCUMENTS

| | | | |
|---|---|---|---|
| 998698 | 9/1951 | France | 36/44 |
| 9011698 | 10/1990 | World Int. Prop. O. | 36/97 |

*Primary Examiner*—Paul T. Sewell
*Assistant Examiner*—Marie Denise Patterson
*Attorney, Agent, or Firm*—Bruce F. Jacobs

[57] ABSTRACT

A shoe construction is provided with means for inclusion or orthotic and/or planar adjustment members in a shoe, without adversely affecting thereby the fit of the shoe on the foot or the distance of the foot from the walking surface.

22 Claims, 6 Drawing Sheets

FOOT SUPPORT SYSTEM FOR SHOES

This is a continuation of copending application Ser. No. 07/598,182 filed on Oct. 15, 1990.

BACKGROUND OF THE INVENTION

Most conventional shoes present severe limitations as to the type and extent of orthopedic corrective devices or 'orthotics' that can be inserted therein, particularly in the forepart, where the insertion of any extra material would affect the fit of the shoe in the usually fixed girth region adjacent the ball, waist, and instep of the foot as well as forwards thereof.

A few extra depth shoes are available in which orthotic devices may extend the full length of the shoe, notably those of P. W. Minor & Sons, Inc. of Batavia, N.Y. However, such shoes have found very limited acceptance. Orthotic inserts or 'orthotics' for use therein are usually designed to correct for pronation or supination of the foot, (i.e. arch considerations), as well as for metatarsal problems, as such they are necessarily limited in thickness to permit the upper to properly fit the forepart of the foot. Also most patients in need of such orthotics insist on being able to use them in their own choice of the widest possible choice of shoe styles. This choice is usually limited by the need for girth adjustment to compensate for the extra volume taken up by the orthotic inserts. This leads to laced shoe styles becoming the preferred choice for such applications. Further limitations orthopedic in nature are presented by the fact that lacing and similar conventional girth adjustment arrangements are rarely useful in the continually flexing ball areas of the foot, for reasons of comfort as well as appearance. Thus the vast majority of orthotic inserts extend only from the heel to the waist area of the shoe (roughly at the midportion thereof) where laces can adjust the shoe girth to accommodate the added volume of the inserts. While such a system can provide proper corrected support to the foot and shoe while the wearer is standing, the available correction decreases to zero during the stride cycle when the weight is transferred to the ball and toes of the foot and therefore off the backpart corrective insert. Thus prior systems afford essentially no corrective support during this most important part of the stride cycle.

In other cases where orthotics are used, particularly when they are used as 'lifts' to compensate for the difference between the length of a patient's legs, such corrections when confined to areas rearward of the ball are only compromise solutions. They afford proper lifting of the short leg while standing, but again offer no consistent and continual correction during the stride cycle because the short leg is provided with no correction when the wearer's weight is fully supported by the ball of the foot. This causes an imbalance in motion, which results in a gimp or uneven stride. This imbalance, depending on its extent, can cause lasting orthopedic damage to parts of the body, including knees, hips, spine, shoulders, and even jaw alignment and function.

Currently, the only orthopedically acceptable solution that is not an improper compromise is to increase the thickness of the entire shoe bottom of the shoe on the 'short leg' foot to provide a completely symmetrical stance. However, many patients stubbornly resist this solution since it renders obvious their infirmity. To avoid being considered somewhat crippled, patients often try to control their stride and thus hide the infirmity, particularly when they think they are being observed, with such stride control often causing damage to knee and/or hip joints.

Another example of problems arising from shoe inserts capable of orthopedically improper use is described in U.S. Pat. No. 3,442,031 in which insole shims inserted in shoes for inside girth adjustment not only alter the designed tread of the shoes, but also cause the balls of the wearer's feet to be at different walking heights from the ground whenever the two feet are of differing girths, as is usually the case.

Another example of inserts adversely effecting the fit of conventional shoes is that of the 'air pumping' insoles described in U.S. Pat. Nos. 4,062,131 and 3,256,621. To date, such insoles have been effective mainly for promotional purposes, as neither functions adequately when used as shown in the disclosures. To function properly with provision for an adequate volume of air transport, the shoe of U.S. Pat. No. 4,062,131 would need thicker resiliently compressible insoles than would be practical in conventional shoe constructions. Such thicker insoles under compression would cause the upper to become too loose to fit properly, causing attendent unsightly and uncomfortable upper buckling and backpart slippage during the stride cycle. U.S. Pat. No. 3,256,621 discloses a thicker sock, which is impractical for the same reasons discussed above. It also provides for openings in the midsole which area is supposed to assist in ventilating the shoe. Such openings are impractical since they permit water and dirt to easily enter the shoe. Moreover, most shoes are sufficiently loose on the foot to allow relatively free transport of air between the upper portions of the shoe and the foot therein, the areas where such ventilating air transport should properly occur, rather than through the edges of the midsole as described in the patent.

Among the objects of the present invention is to provide practical means to solve the aforementioned problems, including means for insertion of orthotic devices including full length orthotics into shoes without adversely affecting the fit of the shoe on the foot thereby, to allow proper orthopedic support correction throughout the stride cycle of the wearer, and to also allow such correction to be applicable to the widest possible variety of shoe styles, including those with no conventional girth adjustment means, such as loafer and other casual styles, boots, women's dress pumps, etc.

Another object of this invention is to provide means whereby such orthotics can compensate for differences between the length of the legs of the wearer not only while standing but during the stride cycle as well.

Still another object of this invention is to provide a means whereby foot support shims, in the form of insole elements substantially each of uniform thickness, can be used to adjust the girth of a shoe to that of a foot inserted therein and/or compensate for moderate leg length discrepancies of a wearer without adversely affecting either the fit of the shoe or the horizontal balance of the wearer's pelvis.

For a fuller understanding of the nature of these and other objects of this invention, reference should be made to the following detailed description taken in connection with the accompanying drawings.

DETAILED DESCRIPTION OF THE INVENTION

Figure 1:
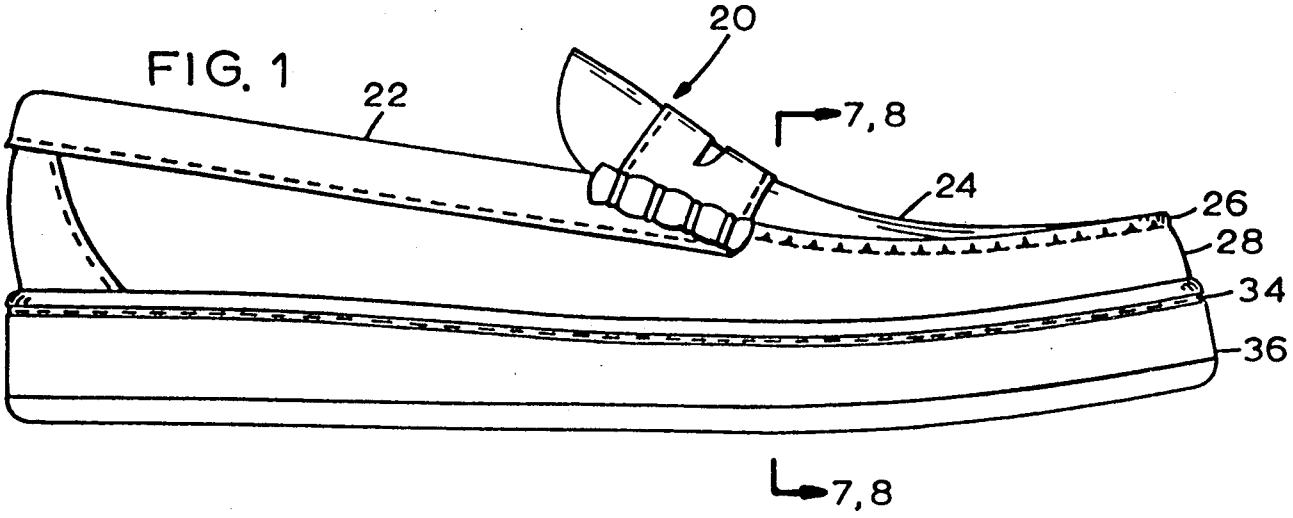
FIG. 1 is a side elevational view of a shoe showing one of the embodiments of the present invention.
Figure 2:
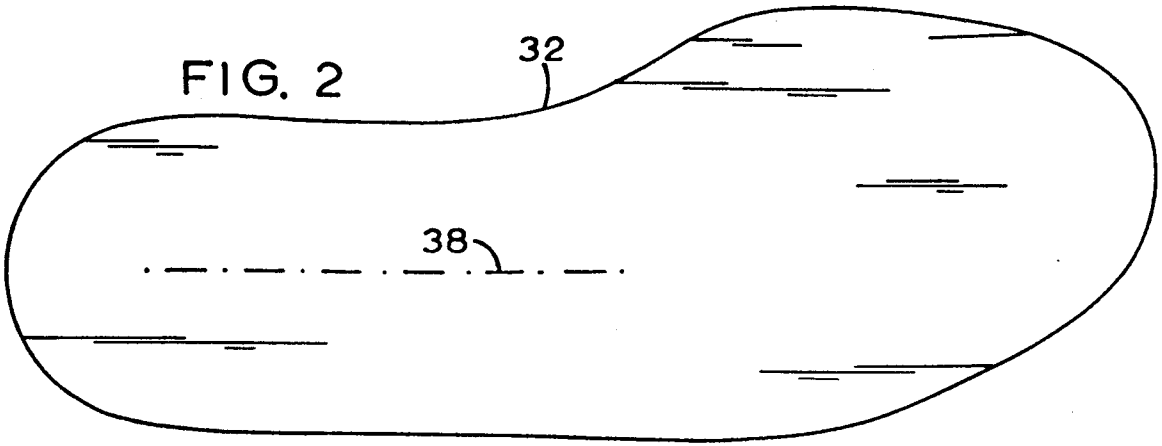
FIG. 2 is a plan view of the socklining of the shoe of FIG. 1.

The construction of the present invention will be described with reference to a moccasin loafer design. It should be understood that this is being done solely for ease of reference and that this invention is applicable to other footwear designs and applications.

Referring to the drawings, FIGS. 1-8 show a shoe 20 comprising an upper 22, having a plug 24 fastened, preferably by stitching 26, to vamp 28. The upper 22 is also connected, preferably by stitching, to a socklining 32 around their mutually peripheral edges, and to unitsole 36 by suitable means such as stitching 34, or adhesive cement (not shown). The socklining may be composed of any suitable relatively non-stretchable material such as Cambrelle ®, a material supplied by the Faytex Corp. of Braintree, Mass., or combinations of leather and/or man-made sheet materials including woven and non-woven fabrics.

As best shown in FIGS. 2 and 5-8, socklining 32 has an optional access opening 38, closeable by a suitable means such as a Velcro ® type hook and loop closure means, available from Velcro ® USA of Manchester, N.H., a zipper, or a pressure sensitive tape, adhesive or similar means, to allow access to chamber 39 defined by socklining 32 and unitsole 36, for the insertion and/or removal of insertable members such as orthotic or other supporting elements therein or therefrom.

Figure 5:
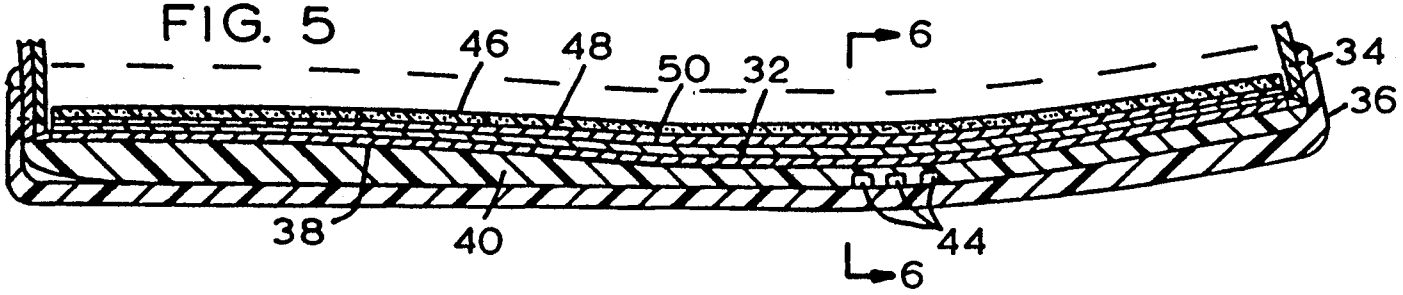
FIG. 5 is a side elevational section of the bottom elements of the shoe of FIG. 1.
Figure 6:
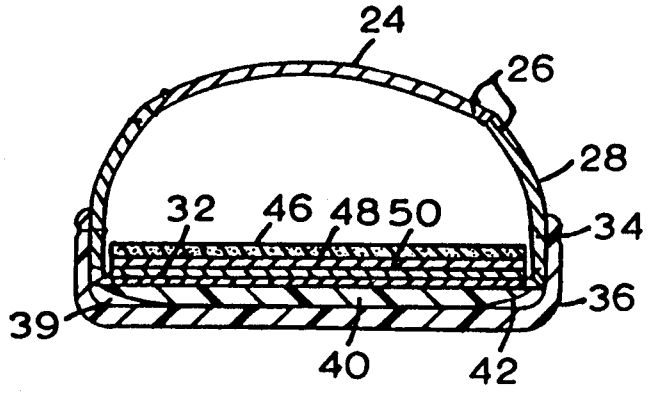
FIG. 6 is a cross-section of the shoe of FIG. 1 taken along line 6—6 thereof.
Figure 7:
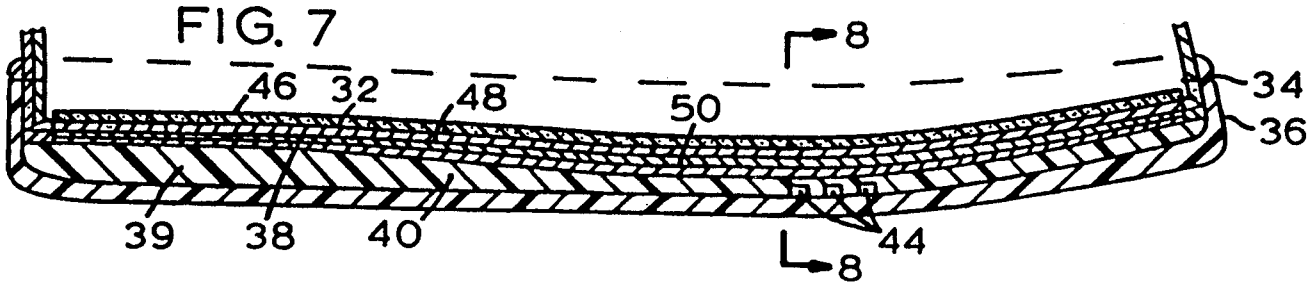
FIG. 7 is another side elevational section of the shoe of FIG. 1.
Figure 8:
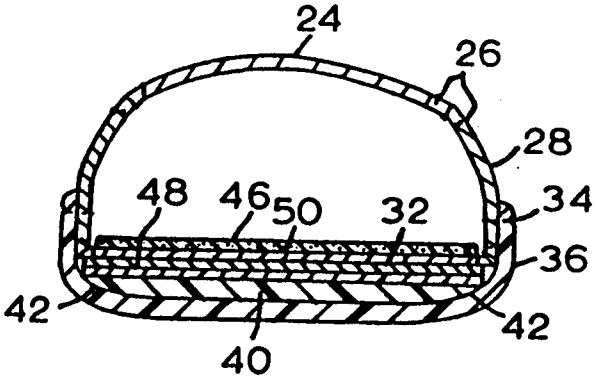
FIG. 8 is another cross-section of the shoe of FIG. 1, taken along line 8—8 thereof.

Two possible arrangements of insertable members 48-50 and platform insert 40 in shoe 20 are shown in FIGS. 5-8. FIGS. 5 and 6 show the shoe of FIG. 1 with insole 46 made of such as Texon ® insole material, supplied by the Texon ® Corp. of Westfield, Mass., in place above and covering the girth or optionally foot height adjustment shims 48 and 50, which in turn lie above socklining 32, shown herein with optional access opening 38, and with platform insert 40 thereunder and within chamber 39. FIGS. 7 and 8 show an alternate arrangement of insertable elements wherein adjustment shims 48 and 50 lie under socklining 32 and over platform insole 40, all of which are within chamber 39. Shims 48 and 50 may be varied in thickness depending upon the girth adjustment desired. Moreover, although not shown, one adjustment shim may be employed or multiple shims may be used. Adjustment shims 48 and 50 may be made of any suitable material such as the well-known Texon ® or similar products thereto.

Figure 3:
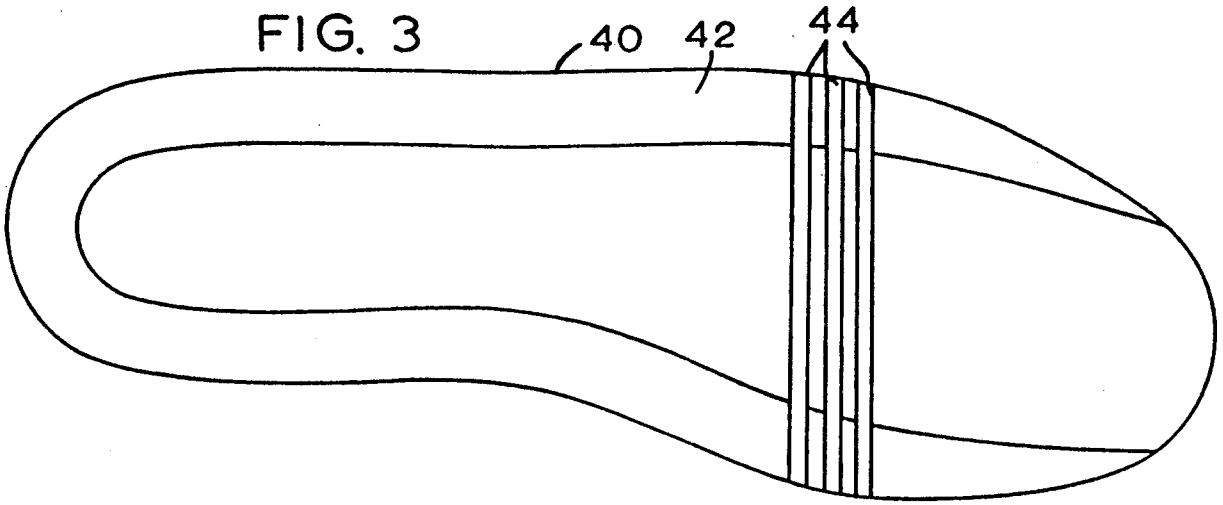
FIG. 3 is a plan view of the platform element of the shoe of FIG. 1.
Figure 4:
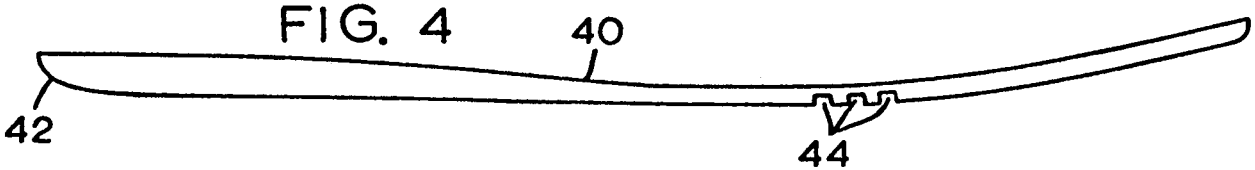
FIG. 4 is a side elevational sectional view of the platform of FIG. 3.

As best shown in FIGS. 3 and 4, platform insert 40, has bevels 42 and hinges 44 which facilitate flexing of the shoe during the stride cycle when in use. Insert 40 may be made of any suitable relatively firm material such as polypropylene, high density polyurethane, nylon, or the like.

In use, by altering the positions of shims 48 and 50 relative to that of socklining 32, the volume of the enclosed upper cavity extending between the enclosed forepart of upper 22 and insole 46 changes. Accordingly, the girth of the shoe can be adjusted by the positioning of shims 48 and 50. As shown by a comparison of FIGS. 6 and 8, unitsole 36 is designed to deform upwardly around the curved, bevelled, or chamfered edges 42 of platform insert 40 which is free to flex transversely at the ball region during the stride cycle as a result of the bevel and hinge construction. When unitsole 36 deforms upwardly, vamp 28 also moves upwardly, thereby increasing the girth of the shoe. The positioning of shims 48 and 50 below socklining 32 in FIG. 8 affords a greater circumference of the cavity enclosed by socklining 48, upper 24, and insole 46, along with an accompanying upward movement of the edges of sole 42 and upper 24. Accordingly, FIGS. 7 and 8 permit greater girth adjustment than FIGS. 5 and 6. Since the number of shims remains constant in the embodiments shown in FIGS. 5-8, the foot in the shoe remains at essentially the same height above the ground in both embodiments.

By changing the total number of shims used or the thickness of the shims and/or platform insert, the shoes can be adjusted to moderate differences in foot girths, and/or simultaneously compensate for moderate differences, i.e. up to about 0.5 inch, in the leg length of the wearer. When compensating for leg length differences, the shoes provide means to balance the wearer's hips so that they will both be an equal distance from the ground on which the wearer is standing or walking.

Other correction means or orthotic devices may be inserted into the chamber 39 including full length orthotics having pronation and metatarsal control means as well as other specific shimming or 'posting' mean to compensate for a variety of specific orthopedic problems. Such insertion of orthotic means would preferably occur subsequent to the manufacture of the shoe, but alternatively, could be effected during the manufacture of the shoe.

Another embodiment according to the present invention is shown in FIGS. 9-13. As shown, shoe 60 comprises an upper 62, having a plug 64 fastened, preferably by machine or handsewing 66, to a unitsole 70 by suitable means, such as adhesive cement (not shown). Upper 68 is attached to a loosely hung lining 74 of a material such as Cambrelle ®, or leather and/or man-made or synthetic fabrics, woven and non-woven, all well-known in the trade, by machine or handsewing 66 as well as by machine stitching along the topline of vamp 68 under cuff 72. Sock 76 lies loosely on the top inner surface of lining 74, with insertable shim element 78 positioned under lining 74, through which it has been inserted into place through the longitudinally oriented, centrally located access slit (opening) 80 in lining 64. Sock 76 may be made of any of a number of suitable conventional sock materials. Insert 78 may also be made of TEXON® board, or molded plastic, such as polypropylene.

Sock 76 is of uniform thickness throughout, while shim 78, although uniform thickness transversely, preferably varies in the amount of such uniform transverse thickness, from about 1/32" in toe and heel areas, gradually increasing therefrom to a preferred constant thickness of about 1/16" to 3/32" in the key girth fitting areas of the ball, waist, and instep, with the waist and instep positions successively back from the ball and adjacent thereto.

Figure 9:
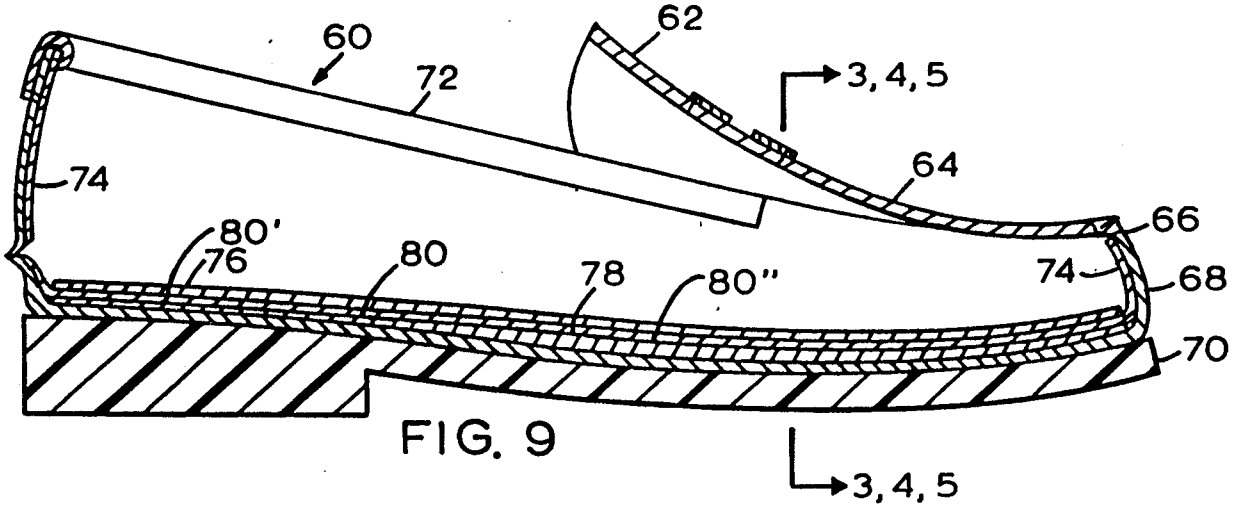
FIG. 9 is a side elevational view of a shoe showing another of the embodiments according to the present invention.
Figure 10:
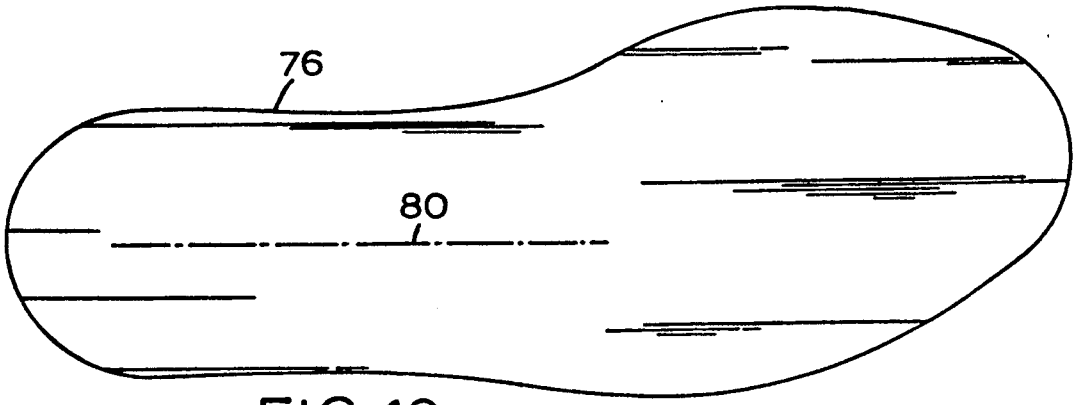
FIG. 10 is a plan view of a shim element of the shoe of FIG. 9.

As shown in FIGS. 9–10, access slit 80 extending between points 80' and 80" in lining 74 allows insertion or removal of insert shim 78. Closure of slit 80 may be effected by any number of well-known closure approaches including pressure sensitive tape, zipper closure, Velcro®, and/or pressure sensitive adhesives.

Figure 11:
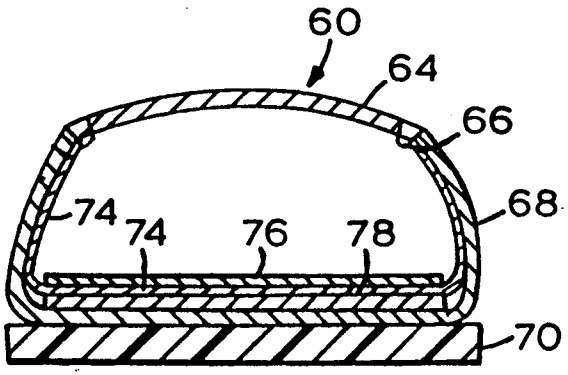
FIG. 11 is a cross-section of the shoe of FIG. 9, taken along the line 3—3 thereof.
Figure 12:
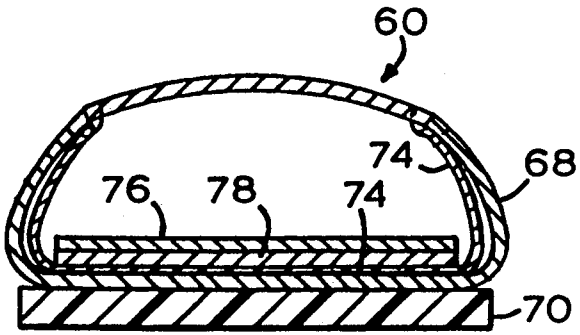
FIG. 12 is another cross-section of the shoe of FIG. 9 taken along the line 4—4 thereof, and drawn as FIG. 9 would appear with changes subsequently described herein.

Two possible arrangements of insert shim 78 relative to lining 74 are shown in FIGS. 11 and 12. In both arrangements, the total thickness under the foot and the consequent height thereof from the walking surface is the same. Girth adjustment is achieved by the selective placement of shim 78 above or below lining 74, with a slight deformation occurring in the side portions of vamp 68 in FIG. 12 as a result of the lower position of lining 74 in that embodiment as compared to FIG. 11. The result is that the embodiment of FIG. 12 achieves greater girth adjustment than the shoe of FIG. 11.

Figure 13:
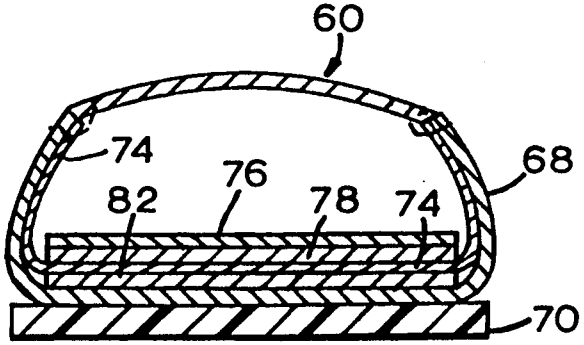
FIG. 13 is a further cross-section of the shoe of FIG. 9, taken along the line 5—5 thereof, and drawn as FIG. 9 would appear with further changes subsequently described herein.

As shown in FIG. 13, shim 82 is designed for optional insertion only in the space between the bottom of lining 74 and vamp 68, where it functions to adjust the shoe for any moderate leg length disparity of the wearer. Also, while this embodiment is shown using a single shim for the sake of ease of understanding, preferably multiple sets of shims would be supplied to the shoe fitter, including somewhat thinner elements for more accurate fitting as well as more extensive ranges thereof. While shims 78 and 42 perform separate and different functions, it will be clear to those skilled in the art that sets of both must be provided to the shoe fitting specialists if they are to be able to adjust a typical single width shoe to the size range of girths and leg length disparities encountered in the buying public.

I claim:

1. A girth adjusting shoe apparatus comprising a shoe having an upper member forming the side, fore, and rear portions of the shoe and attached to a bottom member forming the bottom portion of the shoe so as to define a shoe cavity; a socklining member having an opening therein disposed within the shoe cavity and attached to the upper member so as to divide the shoe cavity into an upper cavity for receiving a foot and a lower cavity; at least one insert member for insertion in the shoe cavity; and a means for adjusting the volume of the upper cavity and thereby adjusting the girth of the shoe while maintaining the foot in the shoe at a substantially constant distance from a walking surface irrespective of the location of the at least one insert member; said adjustment means comprising the combination of the bottom member and the at least one insert member with the bottom member being upwardly deformable in response to the placement of the at least one insert member.

2. The shoe system of claim 1, having two insert members disposed in the upper cavity.

3. The shoe system of claim 1, having two insert members disposed in the lower cavity.

4. The shoe system of claim 1, having two insert members, one insert member being disposed in the upper cavity and the other in the lower cavity.

5. The shoe system of claim 1, wherein the insert member comprises orthotic means for compensating for inequalities in the lengths of the legs of a wearer of the shoe.

6. The shoe system of claim 1, wherein the insert member comprises a shim member for adjusting the fit of the shoe.

7. The shoe system of claim 1, wherein the shoe additionally contains a platform member disposed within the lower cavity.

8. The shoe system of claim 7, wherein the platform member is bevelled to permit the bottom member to deform in use.

9. The shoe system of claim 7, wherein the platform member is hinged to facilitate flexing during use.

10. The shoe system of claim 1, wherein the shoe additionally contains a platform member disposed within the lower cavity and an insert member disposed above the platform member and within the lower cavity.

11. The shoe system of claim 1, wherein the bottom member is deformable.

12. The shoe system of claim 1, wherein the bottom member is a unitsole.

13. A girth adjusting shoe apparatus comprising, a shoe having an upper member and a bottom member forming a shoe cavity, a lining member having an opening therein attached to the upper member and disposed within the shoe cavity so as to define an upper cavity for receiving a foot and a lower cavity; at least one insert member for insertion in the shoe cavity; and a means for adjusting the volume of the upper cavity and thereby adjusting the girth of the shoe while maintaining the foot in the shoe at a substantially constant distance from a walking surface irrespective of the location of the at least one insert member; said adjustment means comprising the combination of the upper member and the at least one insert member, with the upper member being outwardly deformable in response to the placement of the at least one insert member.

14. The shoe system of claim 13, having two insert members disposed in the upper cavity.

15. The shoe system of claim 13, having two insert members disposed in the lower cavity.

16. The shoe system of claim 13, having two insert members , one insert member being disposed in the lower cavity and the other in the upper cavity.

17. The shoe system of claim 13, additionally containing a shim in the lower cavity.

18. A shoe system for compensating for leg length differences of the wearer while permitting girth adjustment comprising a pair of shoes, each shoe having an upper member and a bottom member forming a shoe cavity, a lining member having an opening therein attached to the upper member and disposed within the shoe cavity so as to define an upper cavity for receiving a foot and a lower cavity for receiving an insert member; at least one insert member for insertion in the shoe cavity; a means for adjusting the volume of the upper cavity and thereby adjusting the girth of each shoe while maintaining the foot in each shoe at a substantially constant distance from a walking surface irrespective of the location of the at least one insert member, one of the shoes having a means for elevating the foot for that shoe a greater distance from the walking surface than the foot for the other shoe so as to compensate for a leg length differential.

19. The shoe of claim 18, wherein the elevating means is one of a set of shins of differing thicknesses which may be chosen based on the degree leg length differential.

20. The shoe system of claim 19, wherein the shim is disposed in the lower cavity of the one shoe.

21. The shoe system of claim 20, having two insert members disposed in the upper cavity.

22. The shoe system of claim 20, having one insert member disposed in the upper cavity and one insert member disposed in the lower cavity.

* * * * *